US007595685B1

(12) United States Patent
Sakurai

(10) Patent No.: US 7,595,685 B1
(45) Date of Patent: Sep. 29, 2009

(54) POWER EFFICIENT AND FAST SETTLING BIAS CURRENT GENERATION CIRCUIT AND SYSTEM

(75) Inventor: Satoshi Sakurai, San Diego, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 93 days.

(21) Appl. No.: 12/038,186

(22) Filed: Feb. 27, 2008

(51) Int. Cl.
*G05F 1/10* (2006.01)

(52) U.S. Cl. ..... 327/538; 327/513

(58) Field of Classification Search ..... 323/313, 323/314; 327/512, 513, 538, 539
See application file for complete search history.

(56) References Cited

U.S. PATENT DOCUMENTS 7,307,468 B1 * 12/2007 Vasudevan ..... 327/539
7,532,056 B2 * 5/2009 Seo ..... 327/512

* cited by examiner

*Primary Examiner*—Jeffrey S Zweizig

(57) ABSTRACT

Bias current generation systems are disclosed. In one embodiment, a bias current generation system comprises a proportional to absolute temperature (PTAT) current source generating a PTAT current, a constant current source generating a constant current, a first current mirror forwarding the PTAT current, a second current mirror forwarding an adjusted current, where the adjusted current is the constant current subtracted by the PTAT current if the constant current subtracted by the PTAT current is greater than zero or the adjusted current is zero if the constant current subtracted by the PTAT current is less than zero, a third current mirror forwarding the adjusted current and a fourth current mirror forwarding a bias current generated by subtracting the PTAT current from the adjusted current.

20 Claims, 7 Drawing Sheets

POWER EFFICIENT AND FAST SETTLING BIAS CURRENT GENERATION CIRCUIT AND SYSTEM

FIELD OF TECHNOLOGY

This disclosure relates generally to a bias current generation circuit and system.

BACKGROUND

The settling behavior of amplifier circuit consists of two distinct modes of operation. Initially, the circuit is in a slewing mode, and then it goes into a small signal mode. Thus, the total setting time of the circuit ($ST_{total}$) can be determined based on the time spent for the slewing mode ($ST_{slew}$) and the time spent for settling the small signal mode ($ST_{small\text{-}signal}$), i.e., $ST_{total}=ST_{slew}+ST_{small\text{-}signal}$. The proportion between $ST_{slew}$ and $ST_{small\text{-}signal}$ depends on many factors such as fabrication process used for the circuit components, amount of capacitance each amplifier is driving, the accuracy required for the circuit, and so on. Furthermore, $ST_{slew}=K1*I^{-1}_{bias}$ and $ST_{small\text{-}signal}=K3*I^{-0.5}_{bias}*v^{-0.5}=K2*I^{-0.5}_{bias}*T^{0.75}$ where T is the temperature, K1, K2 and K3 are temperature independent constants, $I_{bias}$ is the bias current for the circuit, and v is the mobility of electrons which is temperature dependant.

Proportional to absolute temperature (PTAT) bias current is often used to maintain the settling behavior of amplifier circuit at hot temperatures. When the temperature goes up from the reference temperature (e.g., room temperature), the circuit slows down because of the slow down of electrons in high or hot temperatures. The PTAT current is used as $I_{bias}$ to compensate for the slowdown of electrons since the PTAT current increases with the temperature rise.

$ST_{small\text{-}signal}$ is maintained over a range of temperature since the bias current (e.g., $I^{-1}_{bias}$) is compensated by temperature (e.g., $T^{0.75}$) as described in the equation. $ST_{slew}$, on the other hand, decreases as the PTAT current used as $I_{bias}$ increases with the rise of temperature. However, when the temperature falls below the reference temperature, $ST_{slew}$ increases as the PTAT current used as $I_{bias}$ decreases. As a result, the degraded settling behavior limits the performance of high speed amplifier circuits at cold or low temperatures.

SUMMARY

This summary is provided to introduce a selection of concepts in a simplified form that are further described below in the detailed description. This summary is not intended to identify key features or essential features of the claimed subject matter, nor is it intended to be used to limit the scope of the claimed subject matter.

An embodiment described in the detailed description is directed to a bias current generation system comprises a proportional to absolute temperature (PTAT) current source generating a PTAT current, a constant current source generating a constant current (e.g., which is with respect to temperature), a first current mirror forwarding the PTAT current, a second current mirror forwarding an adjusted current, where the adjusted current is the constant current subtracted by the PTAT current if the constant current subtracted by the PTAT current is greater than zero or the adjusted current is zero if the constant current subtracted by the PTAT current is less than zero, a third current mirror forwarding the adjusted current and a fourth current mirror forwarding a bias current generated by subtracting the PTAT current from the adjusted current.

As illustrated in the detailed description, other embodiments pertain to electronic systems and circuits that compensate the degraded settling behavior of PTAT bias current in cold temperatures. By adding a constant current to the PTAT bias current in cold temperatures, the degraded settling behavior of a system utilizing the PTAT bias current is improved over cold or low temperatures without increasing the power consumption at room temperature through hot temperature.

BRIEF DESCRIPTION OF THE DRAWINGS

Example embodiments are illustrated by way of example and not limitation in the figures of the accompanying drawings, in which like references indicate similar elements and in which.

Other features of the present embodiments will be apparent from the accompanying drawings and from the detailed description that follows.

DETAILED DESCRIPTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the claims. Furthermore, in the detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Briefly stated, embodiments compensate the degraded settling behavior caused by PTAT bias current in cold temperatures. A constant current source is implemented to compensate the performance of the PTAT current in cold or low temperatures. With the addition of the extra current in cold temperatures, the degraded settling behavior of the circuit utilizing the bias current is enhanced.

Figure 1A:
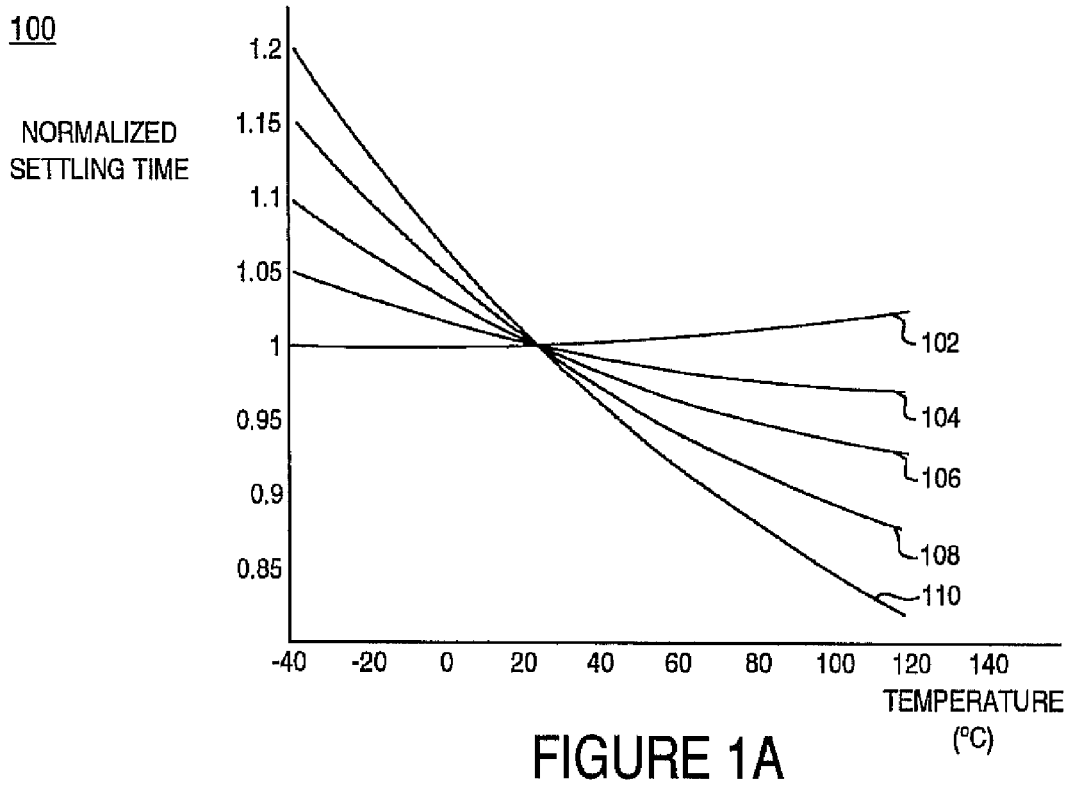
FIG. 1A is a graphical view of normalized total settling times for amplifier circuit using PTAT currents over a range of temperature.

FIG. 1A is a graphical view of normalized total settling times for PTAT currents over a range of temperature. FIG. 1A illustrates the settling behaviors of 5 PTAT currents. If a PTAT current is used as $I_{bias}$, $I_{bias}$ becomes proportional to temperature T, i.e., $I_{bias}$=constant*T. Thus, $ST_{slew}=K4*T^{-1}$ and $ST_{small\text{-}signal}=K5*T^{0.25}$. Then $ST_{total}=K4*T^{-1}+K5*T^{0.25}$, where K4 and K5 are temperature independent constants. FIG. 1A illustrates $ST_{total}$ plotted with different values of K4/K5. The plots are normalized so that $ST_{total}$ for each of them is approximately 1 at room temperature. K4/K5=1 represents the case when constants for $ST_{slew}$ and $ST_{small\text{-}signal}$ are equal.

In FIG. 1A, a line 102 represents the normalized settling time over the temperature range for a PTAT current with K4/K5=5, a line 104 for the same with K4/K5=2, a line 106 for the same with K4/K5=1, a line 108 for the same with K4/K5=0.5 and a line 110 for the same with K4/K5=0.2. As illustrated in FIG. 1A, K4/K5 should fall in the range between 0.25 and 1 for the circuit to maintain its settling time $ST_{total}$ throughout the range of temperature. In addition, it is apparent that $ST_{total}$ is degraded when the temperature falls below the room temperature, but the circuit responds much faster when the temperature goes above the room temperature.

Figure 1B:
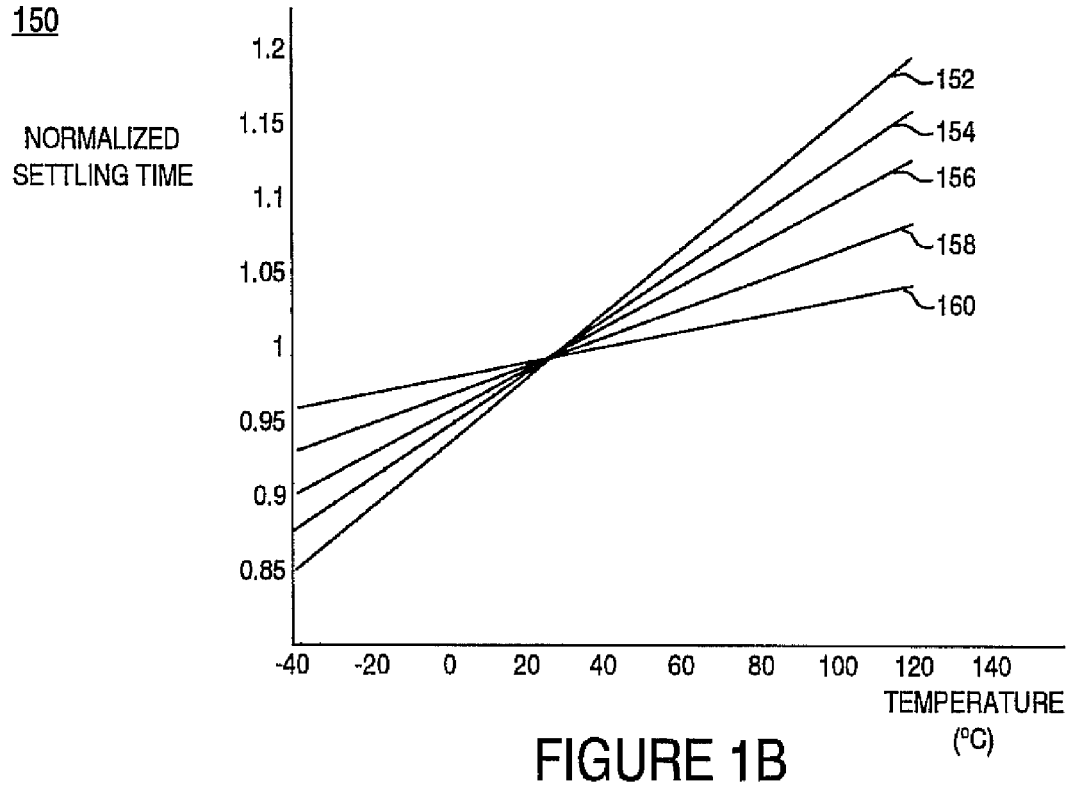
FIG. 1B is a graphical view of normalized total settling times for amplifier circuit using constant currents over a range of temperature.

FIG. 1B is a graphical view of normalized total settling times for constant currents over a range of temperature. FIG. 1B illustrates the settling behaviors of 5 constant currents. If a constant current is used as $I_{bias}$, $I_{bias}$ becomes constant over the range of temperature T, i.e., $I_{bias}$=constant. Thus, $ST_{slew}$=K6 and $ST_{small\text{-}signal}=K7*T^{0.75}$. Then $ST_{total}=K6+K7*T^{0.75}$, where K6 and K7 are temperature independent constants. FIG. 1B illustrates $ST_{total}$ plotted with different values of K6/K7. The plots are normalized so that $ST_{total}$ for each of them is approximately 1 at room temperature. K6/K7=1 represents the case when constants for $ST_{slew}$ and $ST_{small\text{-}signal}$ are equal.

In FIG. 1B, a line 152 represents the normalized settling time over the temperature range for a constant current with K6/K7=5, a line 154 for the same with K6/K7=2, a line 156 for the same with K6/K7=1, a line 158 for the same with K6/K7=0.5 and a line 160 for the same with K6/K7=0.2. As illustrated in FIG. 1B, it is apparent that, regardless the size of K6/K7, $ST_{total}$ improves when the temperature falls below the room temperature, but the circuit responds much slower when the temperature goes above the room temperature.

Figure 2:
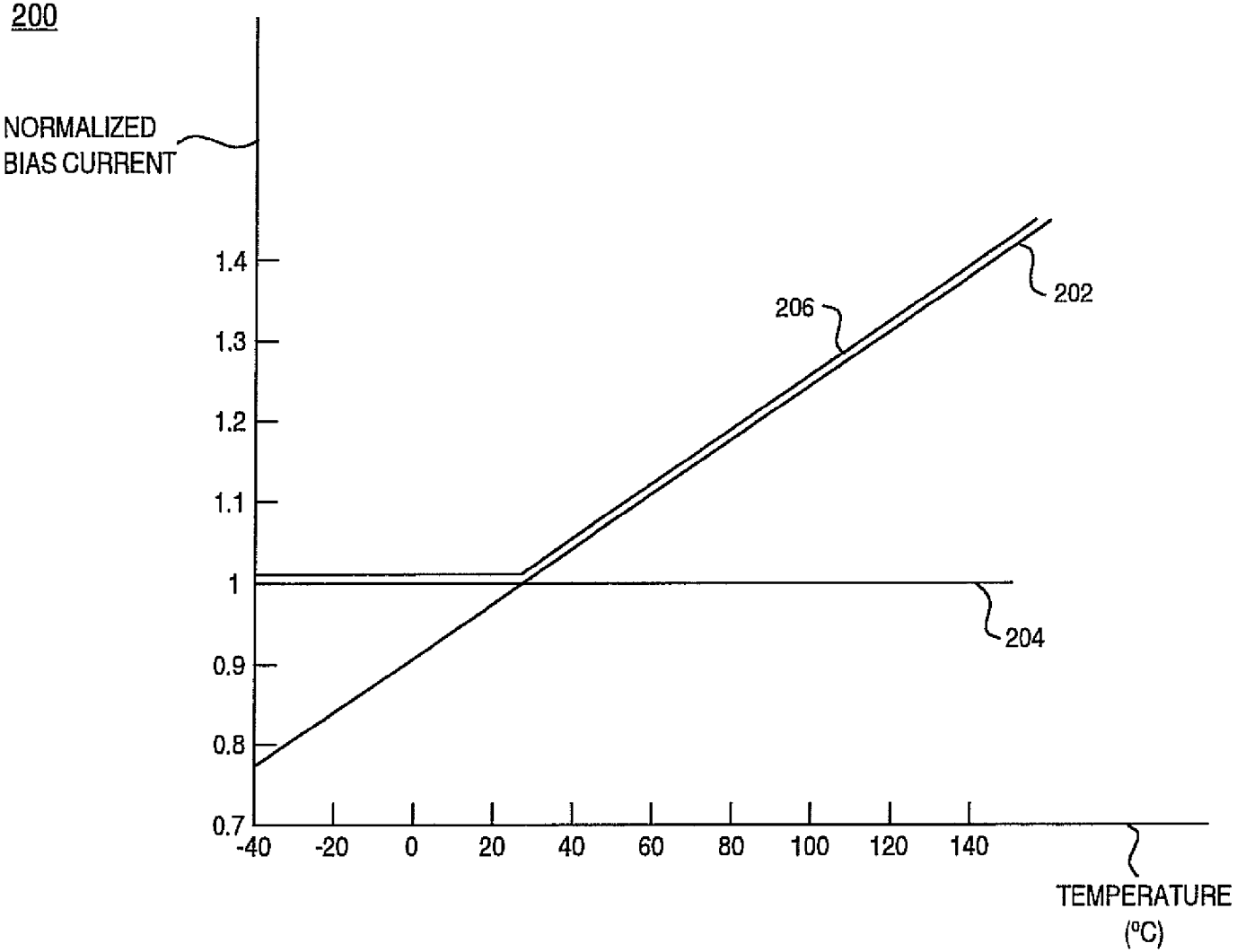
FIG. 2 is an exemplary graphical view of normalized bias current which combines a PTAT current and a constant current, according to one embodiment.

FIG. 2 is an exemplary graphical view of normalized bias current which combines a PTAT current and a constant current, according to one embodiment. As illustrated in FIG. 1A and FIG. 1B, the PTAT current performs well under hot temperature (e.g., above room temperature), whereas the constant current performs better than the PTAT current under cold temperature (e.g., below room temperature). In FIG. 2, a line 202 and a line 204 represent the PTAT current and the constant current, respectively. A line 206 represents the combination of the PTAT current and the constant current which reaps the benefits of the PTAT current at hot temperature and the constant current at cold temperature.

Thus, $I_{bias}=I_{ptat}$, if $I_{ptat}>I_{const}$ but $I_{bias}=I_{const}$ if $I_{ptat}<I_{const}$, where $I_{bias}$, $I_{ptat}$ and $I_{const}$ represent the bias current, the PTAT current and the constant current, respectively. It is appreciated that there could be variations of combinations of currents to generate the bias current. For example, if the nominal value of $I_{const}$ is less than 1, then the extra current in $I_{bias}$ will be seen only at lower temperature than shown in FIG. 2. It is also appreciated that $I_{const}$ can be replaced with a current with slight dependence on temperature.

Figure 3:
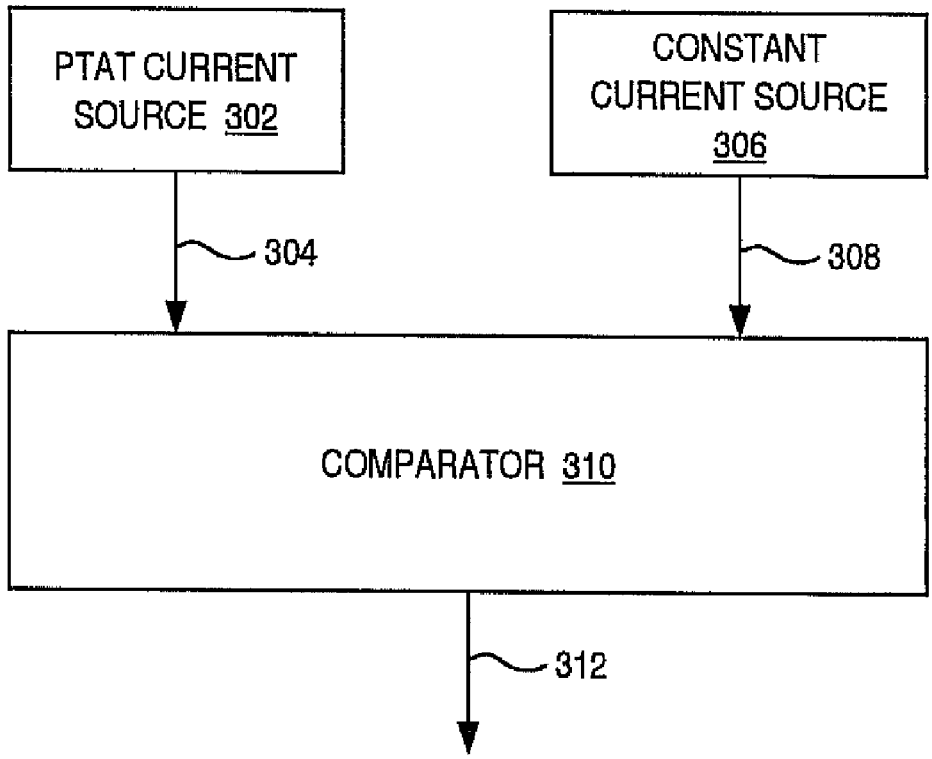
FIG. 3 is an exemplary system diagram of generating a bias current by directly comparing a PTAT current and a constant current, according to one embodiment.

FIG. 3 is an exemplary system diagram of generating a bias current by directly comparing a PTAT current and a constant current, according to one embodiment. In FIG. 3, a PTAT current source 302 generates a PTAT current 304, and a constant current source 306 generates a constant current 308. Then, the PTAT current 304 and the constant current 308 are compared using a comparator 310 to generate a bias current 312. As illustrated in FIG. 2, the comparator 310 forwards the constant current 308 as the bias current 312 if the constant current 308 is greater than the PTAT current 304. However, the comparator 310 forwards the PTAT current 304 as the bias current 312 if the PTAT current 304 is greater than the constant current 308.

Figure 4:
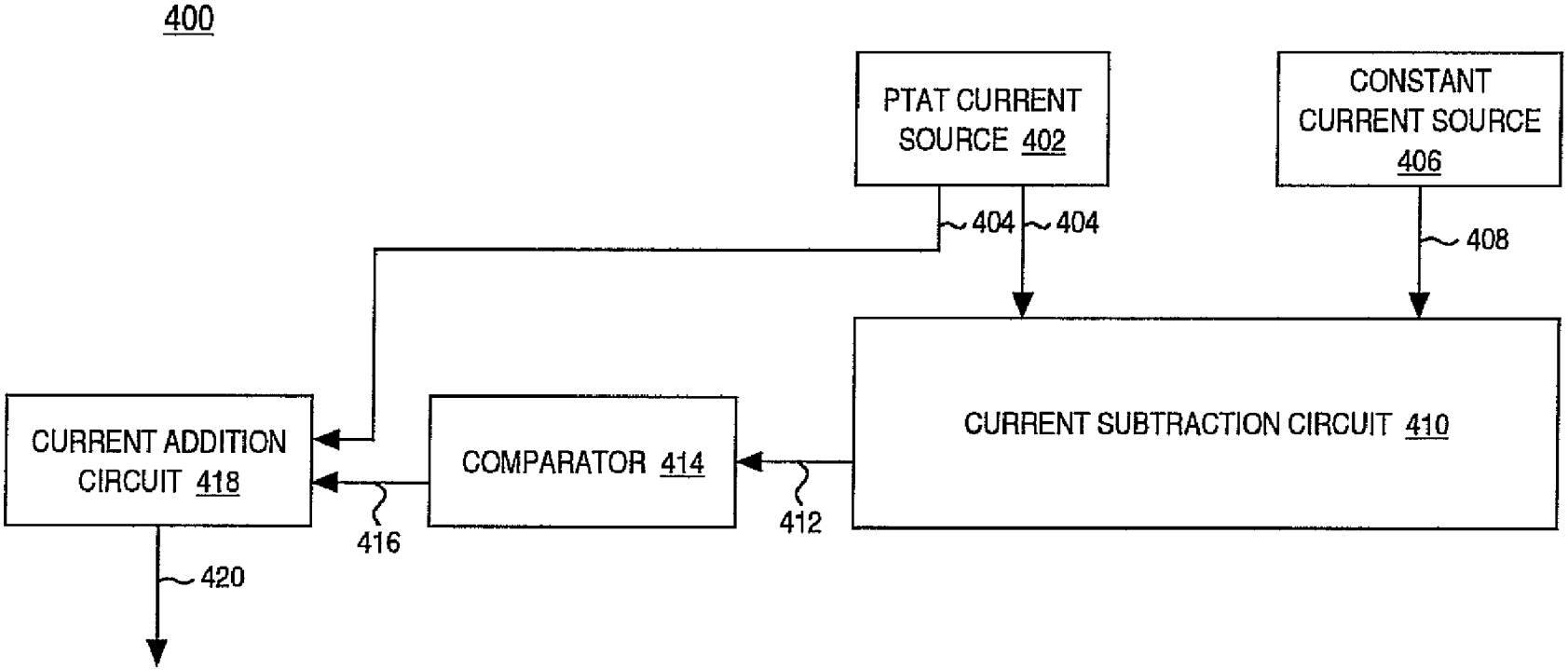
FIG. 4 is an exemplary system diagram of generating a bias current by indirectly comparing a PTAT current and a constant current, according to one embodiment.

FIG. 4 is an exemplary system diagram of generating a bias current by indirectly comparing a PTAT current and a constant current, according to one embodiment. In FIG. 4, a PTAT current source 402 generates a PTAT current 404 and a constant current source 406 generates a constant current 408. A current subtraction circuit 410 is used to subtract the PTAT current 404 from the constant current 408 to generate an adjusted current 412. Then, a comparator module 414 compares the adjusted current 412 with zero.

If the adjusted current 412 is greater than zero, the adjusted current 412 is forwarded as a selected current 416 to a current addition circuit 418. If the adjusted current 412 is less than zero, then zero is forwarded as the selected current 416 to the current addition circuit 418. The current addition circuit 418 then adds the PTAT current 404 and the selected current 416 to generate a bias current 420. Thus, the bias current 420 equals to the constant current 408 if the constant current 408 is greater than the PTAT current 404 and the PTAT current 404 otherwise.

Figure 5:
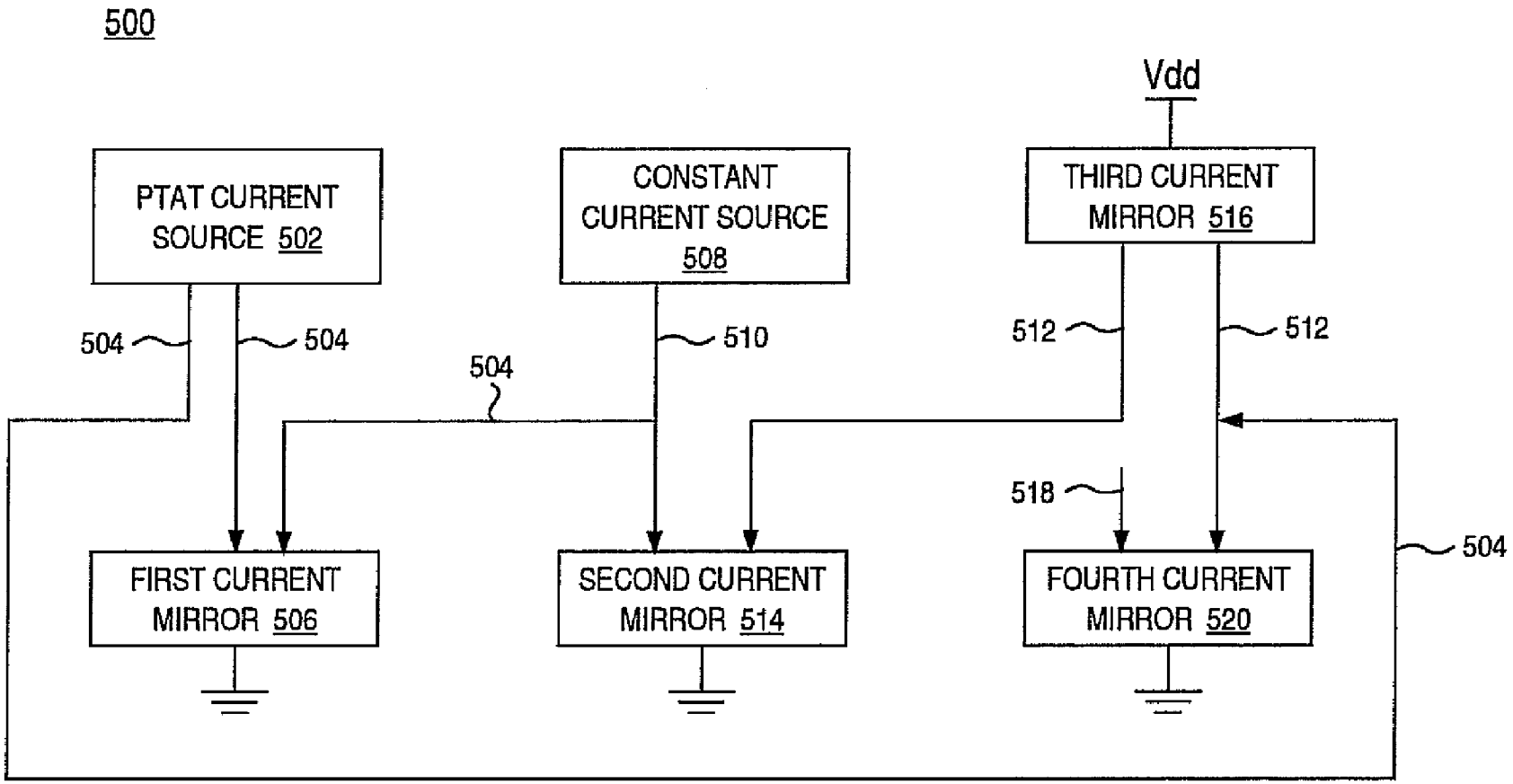
FIG. 5 is an exemplary block diagram of a current source generating a constant bias current below a reference temperature and a PTAT current above the reference temperature, according to one embodiment.

FIG. 5 is an exemplary block diagram of a current source generating a constant bias current below a reference temperature and a PTAT current above the reference temperature, according to one embodiment. In FIG. 5, a PTAT current source 502 generates a PTAT current 504 which is forwarded to a first current mirror 506. A constant current source 508 generates a constant current 510 which is subtracted by the PTAT current 504. An adjusted current 512 is forwarded by a second current mirror 514 which is designed to function only when the input current (e.g., the constant current 510 minus the PTAT current 504) is positive but generates no current when the input current is negative. Then, a third current mirror 516 forwards the adjusted current 512 which is united with the PTAT current 504. A fourth current mirror 520 generates a bias current 518 which mirrors the sum of the adjusted current 512 and the PTAT current 504.

It is appreciated that the first current mirror 506 and the third current mirror 516 may be based on a non-unity current gain. That is, the output current of the first current mirror 506 or the third current mirror 516 can be increased or decreased to many folds.

Figure 6:
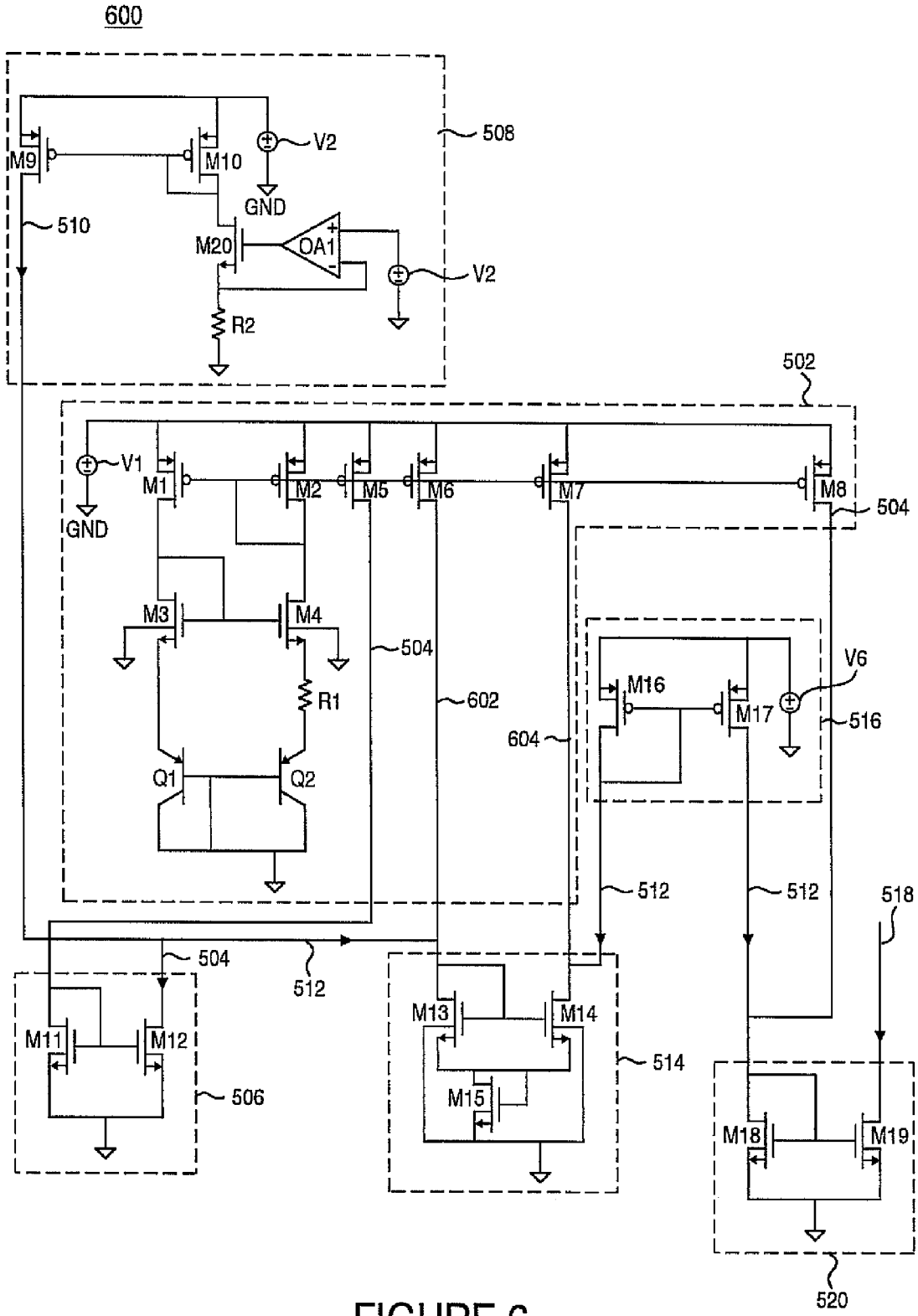
FIG. 6 is an exemplary circuit diagram of a current source generating a constant current below a reference temperature and a PTAT current above the reference temperature, according to one embodiment.

FIG. 6 is an exemplary circuit diagram of a current source generating a constant current below a reference temperature and a PTAT current above the reference temperature, according to one embodiment. FIG. 6 illustrates an exemplary circuit implementation of FIG. 5. It is appreciated that the PTAT current source 502 or the constant current source 508 can be replaced with other types of circuits. It is also appreciated that the current mirror circuits (e.g., 506, 514, 516 and 520) can be replaced with other types of current mirror circuits.

In FIG. 6, the PTAT current source 502 comprises a PNP BJT Q1 connected in series with a NMOS M3 and a PMOS M1 and a PNP BJT Q2 connected in series with a NMOS M4 and a PMOS M2. The collector and base of the PNP BJT Q1 is coupled to the ground, its emitter connected to the source of the NMOS M3. The collector and base of the PNP BJT Q2 is connected to the ground and its emitter connected to a resistor R1, which is connected to the source of the NMOS M4. In addition, the gate of the NMOS M3 is connected to the drain of the NMOS M3 and to the gate of the NMOS M4. The source of NMOS M4 is connected to the resistor R1 and its drain is connected to the gate and drain of the NMOS M2. The gate of the PMOS M1 is connected to the gate of the PMOS M2 and the source the PMOS M1 and the source of the PMOS M2 are connected to a bias voltage V1 (e.g., the $V_{dd}$).

The PTAT current source 502 generates a current proportional to absolute temperature. Accordingly, the PTAT current 504 via a PMOS M5 or a PMOS M8 is proportional to the PTAT current via the resistor R1. It is appreciated that a current 602 via a PMOS 6 and a current 604 via a PMOS M7 is very small compared to the PTAT current 504.

In FIG. 6, the constant current source 508 includes a current mirror circuit based on two PMOSes (e.g., M9 and M10), a NMOS M20, a resistor R2, an operational amplifier OA1 and a voltage source V3. The sources of the two PMOSes are connected to a voltage source (e.g., V2 which may be $V_{dd}$). The drain of the PMOS M10 is coupled to a drain of the NMOS 20. The source of the NMOS 20 is grounded via a resistor R2. The gate of the NMOS 20 is coupled to the output node of the operational amplifier OA1. The positive input node of the operational amplifier OA1 is connected to the voltage source V3, and the negative input node of the operational amplifier OA1 is connected to the source of the NMOS 20. As illustrated in FIG. 6, a bias current of V3/R2 is generated and flows through the resistor R2, the NMOS 20 and the PMOS M10. The bias current is proportionally mirrored as the constant current 510 which flows through a drain of the PMOS M9.

The PTAT current 504 from a NMOS M12 of the first current mirror 506 is subtracted by the constant current 510. The adjusted current 512 is then forwarded by the second current mirror 514 which functions as a typical current mirror circuit when the PTAT current 504 subtracted by the constant current 510 is positive but generates no current when the resulting current is negative. The second current mirror 514 includes three NMOSes (e.g., M13, M14 and M15) with their sources connected to the gate and drain of a NMOS M15 and the source of the NMOS M15 connected to the ground.

The third current mirror 516 which includes a PMOS M16 and a PMOS M17 mirrors the adjusted current 512. The sum of the adjusted current 512 and the PTAT current 504 is then fed to the fourth current mirror 520 (e.g., having a NMOS M18 and a NMOS M19) which generates the bias current 518. The bias current 518 is equivalent to the constant current 510 when the temperature of the circuit in FIG. 6 is less than the reference temperature (e.g., room temperature) but becomes the PTAT current 504 when the temperature of the circuit surpasses the reference temperature.

Figure 7A:
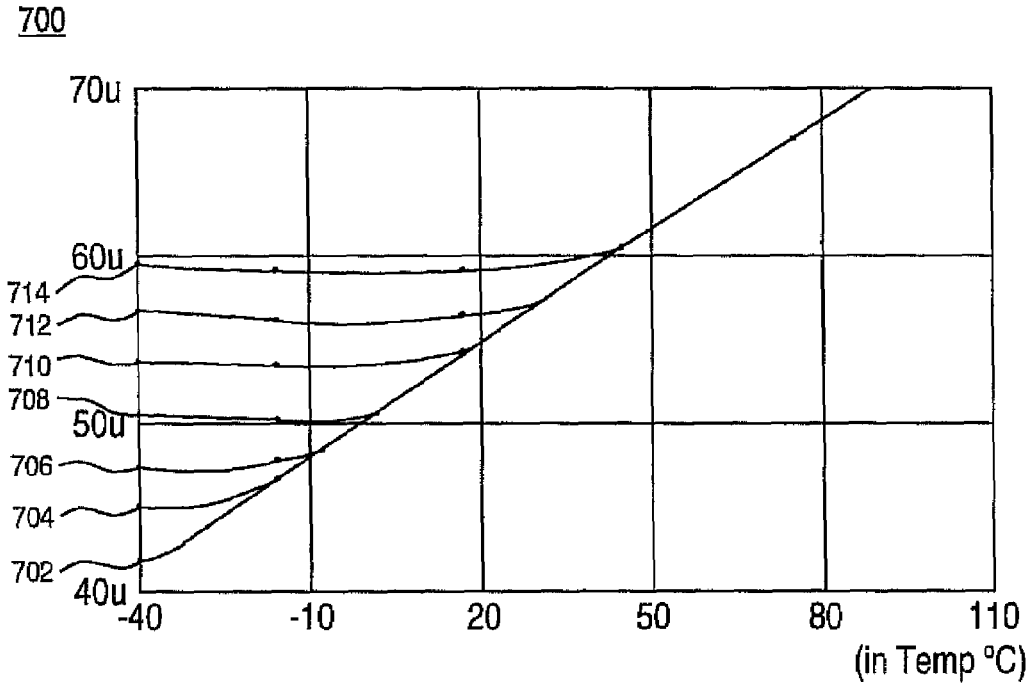
FIG. 7A is an exemplary graphical view of the effect of current mirror constant associated with a constant current source has on a bias current, according to one embodiment.

FIG. 7A is an exemplary graphical view of the effect of current mirror constant associated with the constant current source 508 have on the bias current 518 in FIG. 5, according to one embodiment. In FIG. 7A, the bias current 518 in cold temperatures is changed according to the current mirror constant of the constant current source 508. If the ratio of the current mirror circuit made of the PMOS M9 and the PMOS M10 is a constant value KC to 1, the bias current 518 becomes a PTAT current as KC gets smaller. Thus, a line 702 represents with KC=0.80, a line 704 with KC=0.85, a line 706 with KC=0.90, a line 708 with KC=0.95, a line 710 with KC=1.0, a line 712 with KC=1.05 and a line 714 with KC=1.1. Thus, the amount of the bias current 518 in cold temperatures can be modified by changing KC.

Figure 7B:
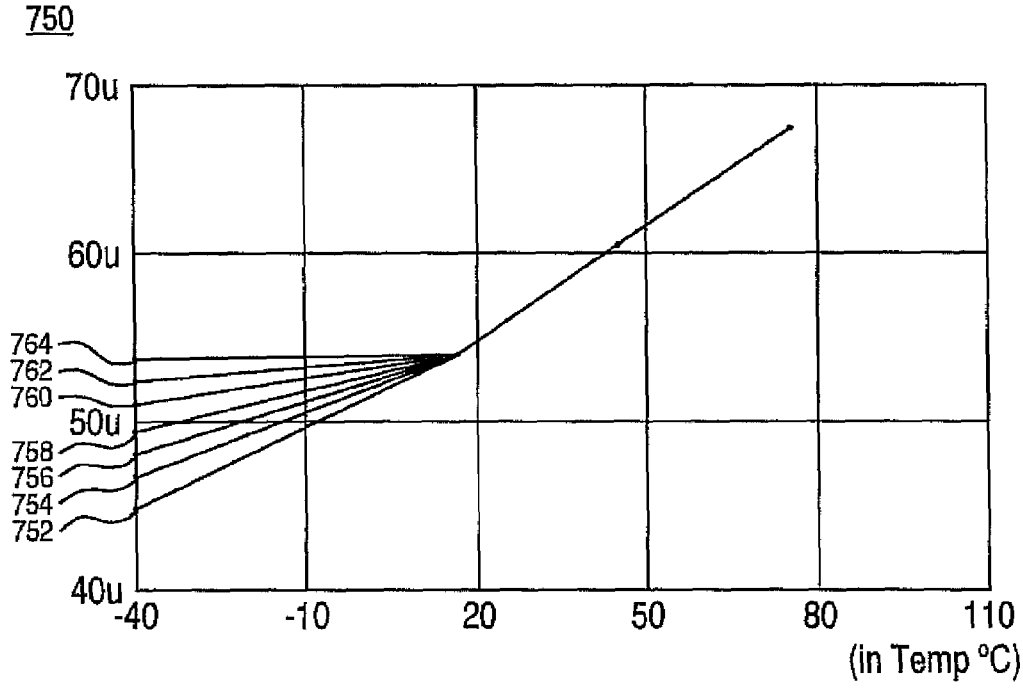
FIG. 7B is an exemplary graphical view of the effect of current mirror constant associated with a PTAT current source have on a bias current, according to one embodiment.

FIG. 7B is an exemplary graphical view of the effect of current mirror constant associated with the third current mirror 516 in FIG. 5, according to one embodiment. In FIG. 7B, the bias current 518 in cold temperatures is changed according to the current mirror constant of the third current mirror 518. If the ratio of the third current mirror 518 made of the PMOS M15 and the PMOS M16 is KA to 1, the slope of the bias current 518 in cold temperatures can be modified by changing KA. Thus, a line 752 represents with KA=1.0, a line 754 with KA=0.90, a line 756 with KA=0.80, a line 758 with KA=0.70, a line 760 with KA=0.60, a line 762 with KA=0.50 and a line 764 with KA=0.40. Thus, the amount of the bias current 518 in cold temperatures can be also modified by changing KA.

Furthermore, with the combination of KA and KC, a bias current which has PTAT characteristics above certain temperature and have some extra current blow that temperature. This can help compensate the settling time degradation of a circuit due to the poor performance characteristics of PTAT current in cold temperatures.

In summary, embodiments described herein pertain to electronic circuits and systems that compensate the degraded settling behavior of PTAT bias current in cold temperatures. By adding a constant current to the PTAT current in cold temperatures, the degraded settling behavior of the circuit biased with PTAT bias current becomes power efficient and fast settling one.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A bias current generation system, comprising:

a proportional to absolute temperature (PTAT) current source generating a PTAT current;

a constant current source generating a constant current; and a comparator coupled to the PTAT current source and the constant current source comparing the PTAT current and the constant current and forwarding a greater one of the PTAT current and the constant current as a bias current.

2. The system of claim 1, wherein the comparator comprises:

a current subtraction circuit forwarding an adjusted current generated by subtracting the PTAT current from the constant current;

a comparator circuit forwarding a selected current by comparing the adjusted current with zero, wherein the selected current is the adjusted current if the adjusted current is greater than zero or the selected current is zero if the adjusted current is less than zero; and a current addition circuit generating the bias current by adding the PTAT current with the selected current.

3. A bias current generation system, comprising:

a proportional to absolute temperature (PTAT) current source generating a PTAT current;

a constant current source generating a constant current;

a current subtraction circuit forwarding an adjusted current generated by subtracting the PTAT current from the constant current;

a comparator forwarding a selected current by comparing the adjusted current with zero, wherein the selected current is the adjusted current if the adjusted current is greater than zero or the selected current is zero if the adjusted current is less than zero; and a current addition circuit generating a bias current by adding the PTAT current with the selected current.

4. The system of claim 3, wherein the current subtraction circuit or the comparator comprises at least one current mirror circuit.

5. A bias current generation system, comprising:

a proportional to absolute temperature (PTAT) current source generating a PTAT current;

a constant current source generating a constant current;

a first current mirror forwarding the PTAT current;

a second current mirror forwarding an adjusted current, wherein the adjusted current is the constant current subtracted by the PTAT current if the constant current subtracted by the PTAT current is greater than zero or the adjusted current is zero if the constant current subtracted by the PTAT current is less than zero;

a third current mirror forwarding the adjusted current; and a fourth current mirror forwarding a bias current generated by subtracting the PTAT current from the adjusted current.

6. The system of claim 5, wherein the bias current is equivalent to the constant current below a reference temperature and the bias current is equivalent to the PTAT current above the reference temperature.

7. The system of claim 6, wherein the reference temperature is room temperature.

8. The system of claim 5, wherein the PTAT current source comprises a first PNP BJT coupled in series with a first NMOS and a first PMOS and a second PNP BJT coupled in series with a second NMOS and a second PMOS.

9. The system of claim 8, wherein the PTAT current source further comprises a resistor coupled between a source of the second NMOS and an emitter of the second PNP BJT.

10. The system of claim 9, wherein the PTAT current is proportional to a current flowing via the resistor.

11. The system of claim 5, wherein the constant current source comprises a current mirror circuit comprising a first PMOS and a second PMOS and a resistor coupled to a drain of the first PMOS and to a ground.

12. The system of claim 11, wherein the constant current is proportional to a current flowing through the resistor.

13. The system of claim 11, wherein the amount of the bias current is modified based on a constant gain factor determined by the first PMOS and the second PMOS.

14. The system of claim 5, wherein the first current mirror comprises two NMOSes.

15. The system of claim 5, wherein the second current mirror comprises two NMOSes with their sources coupled to a drain and a gate of a third NMOS.

16. The system of claim 5, wherein the third current mirror comprises two PMOSes.

17. The system of claim 16, wherein the amount of the bias current in cold temperatures is modified based on a constant gain factor determined by the two PMOSes.

18. The system of claim 5, wherein the fourth current mirror comprise two NMOSes.

19. The system of claim 5, wherein a constant gain factor of the constant current source and a constant gain factor of the third current mirror are modified to generate the bias current equivalent to the PTAT current above a reference temperature and the bias current having the PTAT current plus an additional current below the reference temperature.

20. The system of claim 19, wherein the reference temperature is 27 degrees Celsius.

* * * * *